US009249486B2

(12) United States Patent
Foissey et al.

(10) Patent No.: US 9,249,486 B2
(45) Date of Patent: Feb. 2, 2016

(54) PROFILED STEEL WIRE WITH HIGH MECHANICAL CHARACTERISTICS RESISTANT TO HYDROGEN EMBRITTLEMENT

(75) Inventors: Sylvain Foissey, Meximieux (FR); Christophe Bertout, Viriat (FR); Xavier Perroud, Mollon (FR)

(73) Assignees: ArcelorMittal Wire France, Bourg en Bresse (FR); Thyssenkrupp Steel AG, Duisburg (DE)

( * ) Notice: Subject to any disclaimer, the term of this patent is extended or adjusted under 35 U.S.C. 154(b) by 0 days.

(21) Appl. No.: 13/700,913

(22) PCT Filed: Mar. 23, 2011

(86) PCT No.: PCT/FR2011/000167

§ 371 (c)(1),
(2), (4) Date: Mar. 7, 2013

(87) PCT Pub. No.: WO2011/151532

PCT Pub. Date: Dec. 8, 2011

(65) Prior Publication Data

US 2013/0186521 A1 Jul. 25, 2013

(30) Foreign Application Priority Data

May 31, 2010 (FR) ..... 10 02286

(51) Int. Cl.

| | |
|---|---|
| ***C22C 38/54*** | (2006.01) |
| ***C22C 38/44*** | (2006.01) |
| ***C22C 38/42*** | (2006.01) |
| ***C22C 38/40*** | (2006.01) |
| ***C22C 38/00*** | (2006.01) |
| ***C21D 1/20*** | (2006.01) |
| ***C21D 8/06*** | (2006.01) |
| ***C21D 9/52*** | (2006.01) |
| ***C21D 9/58*** | (2006.01) |
| ***C21D 9/64*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |
| ***C22C 38/20*** | (2006.01) |
| ***C22C 38/22*** | (2006.01) |
| ***C22C 38/24*** | (2006.01) |
| ***C22C 38/32*** | (2006.01) |
| ***C22C 38/46*** | (2006.01) |

(52) U.S. Cl.

CPC . *C22C 38/54* (2013.01); *C21D 1/20* (2013.01); *C21D 8/06* (2013.01); *C21D 9/52* (2013.01); *C21D 9/525* (2013.01); *C21D 9/58* (2013.01); *C21D 9/64* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/20* (2013.01); *C22C 38/22* (2013.01); *C22C 38/24* (2013.01); *C22C 38/32* (2013.01); *C22C 38/40* (2013.01); *C22C 38/42* (2013.01); *C22C 38/44* (2013.01); *C22C 38/46* (2013.01)

(58) Field of Classification Search

USPC ..... 148/330–337

See application file for complete search history.

(56) References Cited

U.S. PATENT DOCUMENTS

| | | | |
|---|---|---|---|
| 5,922,149 | A | 7/1999 | Mallen Herrero et al. |
| 6,527,883 | B1 | 3/2003 | Kawabe et al. |
| 2002/0179207 | A1 | 12/2002 | Koike et al. |

FOREIGN PATENT DOCUMENTS

| | | |
|---|---|---|
| EP | 1 063 313 | 12/2000 |
| EP | 1 273 670 | 1/2003 |
| FR | 2731371 | 9/1996 |
| JP | 59 1631 | 1/1984 |

(Continued)

OTHER PUBLICATIONS

International Search Report Issued Jul. 18, 2011 in PCT/FR11/00167 Filed Mar. 23, 2011.

*Primary Examiner* — Kaj K Olsen
*Assistant Examiner* — Alexander Polyansky
(74) *Attorney, Agent, or Firm* — Davidson, Davidson & Kappel, LLC

(57) ABSTRACT

A profiled wire, of NACE grade, made of low-alloy carbon steel intended to be used in the offshore oil exploitation sector is provided. The profiled wire includes the following chemical composition, expressed in percentages by weight of the total mass: 0.75<% C<0.95; 0.30<% Mn<0.85; Cr≤0.4%; V≤0.16%; Si≤1.40% and preferably ≥0.15%; and optionally no more than 0.06% Al, no more than 0.1% Ni and no more than 0.1% Cu, the balance being iron and the inevitable impurities arising from smelting the metal in the liquid state. The steel is obtained, from hot-rolled rod stock cooled down to room temperature, and then having a diameter of about 5 to 30 mm, by subjecting this starting rod firstly to a thermomechanical treatment comprising two successive steps carried out in order, namely an isothermal quench, giving it a homogeneous perlitic microstructure, followed by a mechanical transformation operation carried out cold with an overall degree of work-hardening (or reduction ratio) of between 50 and 80% at most, so as to give the wire its definitive shape, and in that the profiled wire thus obtained is then subjected to a restoration heat treatment of short duration carried out below Ac1 (preferably between 410 and 710° C.), giving it the desired final mechanical properties.

11 Claims, No Drawings

(56) References Cited

FOREIGN PATENT DOCUMENTS

| | | |
|---|---|---|
| JP | 8 53743 | 2/1996 |
| JP | H08296022 | 11/1996 |
| JP | H11267741 | 10/1999 |
| JP | 2001323324 | 11/2001 |
| JP | 2004 277759 | 10/2004 |
| JP | 2005003893 | 1/2005 |
| JP | 2001271138 | 10/2012 |

PROFILED STEEL WIRE WITH HIGH MECHANICAL CHARACTERISTICS RESISTANT TO HYDROGEN EMBRITTLEMENT

The present invention relates to the field of metallurgy dedicated to offshore oil and gas operations. It relates more particularly to steel wires usable as reinforcing or structural elements of components or constructions submerged in deep water, such as the flexible offshore pipelines.

BACKGROUND

It is known that a primary requirement concerning the wires of this type is, in addition to elevated mechanical characteristics (in particular tensile strength), good hydrogen-embrittlement resistance in sulfide-containing acid media, in particular in the form of $H_2S$ present in the fluids and hydrocarbons being transported.

It is recalled that this resistance is the subject matter of NACE and API standards, particularly:

the NACE TM 0284 standard for the resistance to cracking by hydrogen or "HIC" (Hydrogen Induced Cracking) in seawater saturated with acid $H_2S$;

the NACE TM 0177 standard for the resistance to cracking under $H_2S$ stress, or "SSCC" (Sulfide Stress Corrosion Cracking) in acid media. For the use under consideration here, it is imperative that the profiled wires must now satisfy this, in view of increasingly more difficult operating conditions (great depth);

and the API 17J standard (Specifications for unbonded flexible pipes) for the evaluation of the HIC and SSCC resistances on the basis of a stress test in an acid medium.

These profiled wires may have a round cross section, obtained by simple drawing starting with a wire rod of larger diameter. They may also have a rectangular section after drawing, rolling or drawing followed by rolling, or may be profiled with U-shaped, zeta or teta cross section, etc. in such a way that they can be interlocked with one another along their edges or be joined by folded seams to form articulated reinforcing laps.

Today, the commercial products available in the field of steel wires of NACE quality for offshore use lie mainly in low-alloy steel grades ultimately capable of a final tensile strength (Rm), therefore after quenching and annealing, of approximately 900 MPa.

These profiled wires are usually manufactured in known manner by using carbon manganese steels containing 0.15 to 0.80% C (by weight) and initially having pearlito-ferrite structure. Traditionally, after the initial round, rolled wire rod has been profiled, it is subjected to appropriate stress-relief heat treatment to obtain the required hardness. It is by virtue of this hardness that the nominal criteria for use are respected, for example the ISO 15156 standard, which stipulates that these Mn steel grades must have a stress resistance in $H_2S$ media suitable for the "profiled wire" use in question here, if the wire hardness is lower than or equal to 22 HRC.

However, the profiled wires obtained by the traditional methods have the reputation of being poorly able to resist the relatively severe acidity conditions encountered in deep waters, those provided for by the NACE TM 0177 standard with solution A (pH 2.7 to 4) in this case, due to the concentrated presence of $H_2S$ in the hydrocarbon being transported, all the more so if the targeted hardness levels are greater than 28 HRC (greater than 900 MPa).

This is undoubtedly also the reason for which the document PCT/FR91/00328, published in 1991, describes a thermomechanical method for producing a profiled wire of pearlito-ferritic structure that has a carbon content of between 0.25 and 0.8% and that satisfies the NACE TM 0177 and TM 0284 standards with solution B (pH 4.8 to 5.4), albeit at the cost of final annealing, which relaxes the mechanical strains imposed by work-hardening of the metal and thus lowers the tensile strength (Rm) to approximately 850 MPa.

The document FR B 2731371, published in 1996, also relates to the production of profiled wires of carbon steel for reinforcement of flexible offshore pipelines whose resistance to acid media containing $H_2S$ is sought at a high level on the basis of general knowledge about the influence of steel microstructures on its resistance to hydrogen-induced embrittlement. The profiled wire proposed in this document, containing 0.05 to 0.8% C and 0.4 to 1.5% Mn, has been subjected after forming (drawing or drawing and rolling) to quenching followed by final annealing. The metal structure obtained is substantially an annealed martensitic bainite. In this way, profiled wires ready for use would be obtained, which wires would have elevated mechanical characteristics, i.e. an Rm close to 1050 MPa (therefore in a quenched and tempered steel to attain hardness levels as high as 35 HRC, but observed in the industry to be closer to approximately 820 MPa) and consequently would be able to clearly exceed those recommended by the ISO 15156 standard, and would be resistant to very acidic media (pH close to 3). It is stipulated therein that, in the absence of final annealing, a wire can be obtained that has superior hardness along with even higher mechanical characteristics, although consequently with clearly less chemical resistance to acid media.

In fact, it is found that the characteristics of very high level that are usually required of such wires actually have to be satisfied only in a limited number of cases of use.

In agreement with the NACE quality, a resistance in conformity with the aforesaid API 171 standard, with an $H_2S$ partial pressure that may attain 0.1 bar and with a pH of 3.5 to 5, would actually be sufficient to cover the essentials of the effective needs, whereas the profiled wires manufactured by the method according to the document mentioned in the foregoing have what we might call over-qualified resistance, because they meet the elevated requirements of the TM 0177 and TM 0284 standards established with solution A, having a pH of approximately 3.

Furthermore, it turns out that the usual profiled wires on the market, with pearlito-ferritic structure without final heat treatment, are unsuitable most of the time for satisfying even the moderate NACE requirements.

In addition, since flexible offshore pipelines are being called upon for use at progressively greater submersion depths, a demand is now actually developing in favor of strengths further increased by several hundred MPa, in order to attain, shall we say, strengths on the order to 1300 MPa and even higher, without in turn degrading the NACE quality, while it must be recalled that embrittlement of the steel by hydrogen-induced corrosion and mechanical characteristics are opposing properties: seeking to favor one is doing so to the detriment of the other, and vice versa.

In addition, steadily increasing market pressure is being felt on the prices, with the consequence of greater than the usual recourse to noble alloying elements, such as chromium, niobium, etc., or long or multiple and therefore costly treatment steps, especially if they must be carried out at high temperature.

In this regard, particular note will be made of the teaching of JP 59001631 A of 1984 (DATA BASE WPI Week 198407 Thomson Scientific, London, GB; AN 1984-039733), which recommends a final long-duration recovery treatment of the wire, in the form of annealing for several hours.

Similarly, the method described in EP 1063313 AI imposes very high work-hardening ratios of the wire, close to 85%, to achieve the desired final diameter by drawing.

Note also will be made of the existence of EP 1273670 relating to the manufacture of steel bolts, but wherein the teaching emphasizes the advantage that may be expected in the corrosion resistance under tension of pearlitic bolts.

BRIEF SUMMARY

An object of the present invention is to achieve an optimum equilibrium between a necessary good resistance to wet hydrogen-induced embrittlement under the conditions of use of the profiled wire and an increased mechanical strength thereof, and to do so in the context of industrial production that will make it possible to offer the wire on the market at attractive economic conditions.

To this end, the present invention provides a profiled wire of hydrogen-embrittlement-resistant, low-alloy carbon steel having high mechanical characteristics, which profiled wire is intended to be used as a constituent of flexible pipelines for the offshore oil and gas operations sector, characterized in that it has the following chemical composition, expressed in percentages by weight of the total mass, $0.75<C\ \%<0.95$ and $0.30<Mn\ \%<0.85$ with $Cr\leq0.4\%$; $V\leq0.16\%$; $Si\leq1.40\%$ and preferably 0.15%, and possibly not more than 0.06% Al, not more than 0.1% Ni and not more than 0.1% Cu, the rest being iron and the inevitable impurities originating from smelting of the metal in the liquid state, and in that, starting from a wire rod, hot-rolled in its austenitic region above 900° C. then cooled to ambient temperature, and then having a diameter of approximately 5 to 30 mm, the profiled wire is obtained by subjecting the said starting wire rod first to a thermomechanical treatment according to two successive and ordered steps, specifically isothermal quenching (traditionally patenting in lead), which confers on it a homogeneous pearlitic microstructure, followed by an operation of cold mechanical transformation (drawing, or drawing+rolling), carried out with a global work-hardening ratio of between approximately 50 and 80% maximum (and preferably around 60% if possible), to give the wire its final profile, and in that the profiled wire obtained in this way is then subjected to a short-duration recovery heat treatment (preferably of shorter than one minute) carried out below the Ac 1 temperature of the steel constituting it (preferably between 410 and 710° C.), thus conferring on it the desired final mechanical characteristics.

The invention that has just been defined in the foregoing is based on the three components: "steel grade—treatment—application", and may be seen as optimization of the knowledge acquired by the Applicant in the field of metallurgy of steel wires intended to be used in the deep sea.

More explicitly, these three components are described in detail as follows:

a simplified steel grade, meaning a steel containing carbon (at least 0.75%) and manganese, which therefore contrasts with the very much lower carbon contents commonly used, and without addition of quenching elements, but preferably alloyed with dispersoid elements, such as vanadium and chromium, to obtain a homogeneous distribution of fine carbides throughout the metal matrix;

this grade is produced by starting from a wire rod that has been hot-rolled then cooled to ambient temperature (and therefore has ordinary ferrito-pearlitic structure derived from the austinite of hot-rolling), but the diameter of which (between approximately 5 and 30 mm) is reduced relative to the usual practice. This arrangement will permit its transformation into final ready-to-use profiled wire by operations of gentle mechanical profiling, in other words without too intensive work-hardening at the core, which could create zones of heterogeneity, its being clarified that it is of course up to the operator assigned the task of the manufacturing method to adjust the functioning parameters (settings of the operational parameters, choice of drawing dies and of grooves of the rolling cylinders) in order to limit local work-hardening phenomena at the core of the wire.

The microstructure to be created by the isothermal quenching is pearlite. Since it is readily obtained in industry, pearlite will assure the most homogeneous possible metallurgical structure throughout the entire mass of the wire obtained and will be capable of undergoing the deformations applied by drawing and/or rolling.

this wire is a flat, rectangular or shaped profiled wire, intended for "offshore" oil and gas operations, to constitute the winding, hoop or arch wire integrated in the structure of pipelines and other flexible conduits. As is known, the profiled wires of steel in the pipelines are disposed between two layers of extruded polymers, in what is known as an "annular" zone. The physicochemical conditions prevailing in this zone during use of the flexible pipeline are now better known. They depend on the nature of the fluid in the flexible pipeline (liquid or gaseous hydrocarbons) and on the structure of the different layers of the flexible pipeline. In particular, the pH is higher than was thought in the years from 1990 to 2000 (around 5.5 on average, rather than 4).

The invention therefore finds its primary motivation in the discovery of these new, less drastic conditions to be satisfied in the annular zone, thus permitting the use of profiled wires of higher mechanical strength.

Stated otherwise, the NACE quality today may be expressed with complete validity through results of tests less severe than those provided by the API standard (the Applicant therefore had to adjust the test conditions in relation to the API standard, especially the pH, in order to adapt to the Application). For example, the NACE quality may be awarded to a steel wire that has withstood a continuous stress of 90% of Re in an aqueous solution having a pH of between 5 and 6.5 in the presence of bubbling gas containing $C0_2$ and a few millibars of $H_2S$ for one month without break or internal cracking.

The invention will be better understood and other aspects and advantages will become more apparent by reading the description hereinafter, given by way of example.

DETAILED DESCRIPTION

Table I, presented on the last page of this description, shows seven examples of chemical compositions of grades conforming to the invention, identified in the first column by a nomenclature internal to the Applicant.

An example of composition will now be considered in detail, taken from the steel grade referenced C88 (second-last row of Table I), the present components of which satisfy the following precise contents by weight: C: 0.861%; Mn: 0.644%, P: 0.012%, S: 0.003%, Si: 0.303%, AI: 0.47%, Ni: 0.015%, Cr: 0.032%, Cu: 0.006%, Mo: 0.003%, and V: 0.065%.

Starting from a round wire rod of 12 mm diameter, a final ready-to-use wire of rectangular shape with dimensions of 9 mm×4 mm is produced according to the following successive operations.

It is pointed out beforehand that, in agreement with the invention, a diameter of 30 mm for the starting wire rod while cold will not be exceeded, in order to avoid pronounced work-hardening of the core of the wire during the subsequent drawing, which is carried out with a global work-hardening ratio not exceeding 80%, so as to achieve the desired final diameter of the ready-to-use profiled wire.

The wire rod is a hot-rolled steel rod, i.e. in its austenitic range (traditionally above 900° C.), which is then cooled rapidly in the rolling heat before being wound in a coil to complete cooling to ambient temperature in a storage area, while awaiting delivery to the customers.

Once delivered to the processing shop, this starting wire rod, which is unwound from its coil, is first subjected to isothermal quenching from room temperature. Traditionally this involves patenting at constant temperature around 520-600° C. by passage through a molten lead bath, before cooled. This patenting confers on the steel wire a pearlitic microstructure, with possible traces of ferrite but without bainite or martensite, which structure it will retain until the end.

The wire is then drawn (round or already rectangular) in "gentle" manner, which means, as already mentioned hereinabove, in such a way as to limit to the maximum the level of stresses at the core, which will confer thereon the work-hardening of the metal. The reason for this is that it is advisable to limit the damage to the microstructure at the core, which damage would create sites favorable to preferential accumulation of hydrogen. It will then be possible to subject the wire to cold-rolling to achieve the final dimensions, its being clarified that the global work-hardening ratio (drawing+rolling) will be between 50 and 80% maximum, and preferably around 60% if possible.

The intermediate wire obtained in this way has an Rm of approximately 1900 MPa.

It still has to be softened to facilitate its subsequent shaping and to confer its properties of resistance to hydrogen-induced embrittlement, since these are little altered by the work-hardening. For this purpose, a simple final, rapid recovery heat treatment, therefore at a temperature below its Ac 1 value between 410 and 710° C. for the entire range of steel grades used), lasting less than one minute, will confer on it the desired final Rm, the exact value of which will of course depend on the operating conditions of this recovery treatment.

In this regard, Table II hereinafter presents the final mechanical characteristics obtained for a profiled wire that has been subjected to a rapid recovery heat treatment under the following operating conditions, identified by rows A to E: dwell time of 5 seconds at a temperature below the Ac 1 temperature of the steel grade under consideration and given in the second column of the table, before quench cooling in water.

The other columns respectively indicate the mean tensile strength Rm, the mean yield strength Re, the mean elongation at break A % of the treated wire resulting from the applied thermomechanical operations, and the Re/Rm ratio.

It will be noted, as could have been expected, that both the Rm and the Re decrease regularly when the recovery temperature becomes higher (rows from A to E). The Re/Rm ratio remains constant and the percentage elongation A % increases in the same sense.

TABLE II

| | Recovery temp. (° C.) | Mean Rm (MPa) | Mean Re (MPa) | Mean A % | Re/Rm |
|---|---|---|---|---|---|
| A | 410 | 1920 | 1730 | 9.6 | 0.90 |
| B | 500 | 1760 | 1530 | 9.7 | 0.86 |
| C | 600 | 1550 | 1360 | 11.0 | 0.87 |
| D | 635 | 1480 | 1280 | 12.0 | 0.86 |
| E | 675 | 1380 | 1190 | 11.6 | 0.86 |

The NACE tests of the RIC (Hydrogen-Induced Cracking) and SSC (Sulfide Stress Cracking) types were carried out on each of the wires obtained after these different recovery treatments. The data and results are presented in Table III below. It is seen that all the samples analyzed respond positively to the tests: after ultrasonic inspection, no internal cracking of the blister type, which would be evidence of hydrogen-induced corrosion embrittlement, is observed.

TABLE III

| | Rm (in MPA) | NACE test type | Duration (in days) | H2S % | pH | Applied stress in SSC | US results |
|---|---|---|---|---|---|---|---|
| A | 1920 | HIC + SSC | 30 | 0.1 | 5.8 | 90% Re | OK |
| B | 1760 | HIC + SSC | 30 | 0.1 | 5.8 | 90% Re | OK |
| C | 1550 | HIC + SSC | 30 | 0.22 | 5.6 | 90% Re | OK |
| D | 1480 | HIC + SSC | 30 | 0.22 | 5.6 | 90% Re | OK |
| E | 1380 | HIC + SSC | 30 | 0.22 | 5.6 | 90% Re | OK |

It is self-evident that the invention would not be limited to the described examples but instead extends to multiple variants and equivalents that fall within its definition as given by the attached claims.

TABLE I

| Code of | C % | | Mn % | | P % | | S % | | Si % | | Al % | | Ni % | |
|---|---|---|---|---|---|---|---|---|---|---|---|---|---|---|
| grade | Mini | Maxi | Mini | Maxi | Mini | Maxi | Mini | Maxi | Mini | Maxi | Mini | Maxi | Mini | Maxi |
| C 78 D2 | 0.75 | 0.80 | 0.50 | 0.70 | | 0.02 | | 0.02 | 0.15 | 0.30 | 0.02 | 0.06 | | 0.08 |
| C 82D2 | 0.80 | 0.85 | 0.50 | 0.70 | | 0.02 | | 0.02 | 0.15 | 0.30 | 0.02 | 0.06 | | 0.08 |
| C82 | 0.77 | 0.85 | 0.65 | 0.85 | | | | | | | | | | |
| C 86 D2 B | 0.83 | 0.88 | 0.50 | 0.70 | | 0.02 | | 0.02 | 0.15 | 0.30 | | 0.005 | | 0.10 |
| C 86D2 | 0.82 | 0.88 | 0.65 | 0.85 | | 0.02 | | 0.02 | 0.15 | 0.30 | 0.02 | 0.06 | | 0.10 |
| C88 | 0.80 | 0.90 | 0.50 | 0.70 | | 0.02 | | 0.02 | 0.20 | 0.35 | 0.02 | 0.06 | | 0.10 |
| C92 | 0.88 | 0.95 | 0.30 | 0.60 | | 0.015 | | 0.015 | 1.00 | 1.40 | | 0.005 | | 0.10 |

| Code of | Cr % | | Cu % | | Mo % | | V % | | B % | | N2% | |
|---|---|---|---|---|---|---|---|---|---|---|---|---|
| grade | Mini | Maxi | Mini | Maxi | Mini | Maxi | Mini | Maxi | Mini | Maxi | Mini | Maxi |
| C 78 D2 | | 0.10 | | 0.08 | | 0.02 | | | | | | 0.007 |
| C 82D2 | | 0.10 | | 0.10 | | 0.02 | | | | | | 0.007 |
| C82 | 0.02 | 0.10 | | | | | 0.03 | 0.16 | | | | 0.007 |
| C 86 D2 B | | 0.10 | | 0.12 | | 0.025 | | | 0.002 | 0.007 | | 0.007 |

TABLE I-continued

| | | | | | | | |
|---|---|---|---|---|---|---|---|
| C 86D2 | | 0.10 | 0.10 | 0.02 | | | 0.007 |
| C88 | | 0.10 | 0.10 | 0.01 | 0.05 | 0.10 | 0.008 |
| C92 | 0.10 | 0.30 | 0.10 | | | | 0.007 |

What is claimed is:

1. A profiled wire of hydrogen-embrittlement-resistant, low-alloy carbon steel for flexible pipelines for the offshore oil and gas operations sector, comprising:

a chemical composition, expressed in percentages by weight of the total mass, 0.75<C %<0.95;

0.30<Mn %<0.85;

Cr≤0.4%;

V≤0.16%; and

Si≤1.40% the rest being iron and the inevitable impurities originating from smelting of the metal in the liquid state, and in that, starting from a wire rod, hot-rolled in its austenitic region above 900° C. then cooled to ambient temperature, and then having a diameter of approximately 5 to 30 mm, it is obtained by subjecting the said starting wire rod first to a thermomechanical treatment according to two successive and ordered steps, specifically isothermal quenching, which confers on it a homogeneous pearlitic microstructure, following by an operation of cold mechanical transformation, carried out with a global work-hardening ratio of between approximately 50 and 80% maximum, to give the wire its final profile, and in that the profiled wire obtained in this way is then subjected to a short-duration recovery heat treatment carried out below the Ac 1 temperature of the steel with a temperature of between 410 and 710° C. for a duration not exceeding one minute.

2. A The profiled wire according to claim 1, wherein the isothermal quenching is a patenting operation in lead at a constant temperature from 520 to 600° C.

3. The profiled wire according to claim 1, wherein Si≥0.15%.

4. The profiled wire according to claim 1, wherein the composition includes Al≤0.06%.

5. The profiled wire according to claim 1, wherein the composition includes Ni≤0.1%.

6. The profiled wire according to claim 1, wherein the composition includes Cu≤0.1%.

7. The profiled wire according to claim 1, wherein a mean tensile strength Rm is from 1380 to 1920 MPa.

8. The profiled wire according to claim 1, wherein a mean yield strength Re is from 1190 to 1730 MPa.

9. The profiled wire according to claim 1, wherein a mean elongation at break is from 9.6 to 12.0%.

10. The profiled wire according to claim 1, wherein a Re/Rm ratio is from 0.86 to 0.90.

11. The profiled wire according to claim 1, wherein the final profile of the wire is 9 mm by 4 mm.

* * * * *